US009315905B2

(12) United States Patent
Ridgeway

(10) Patent No.: US 9,315,905 B2
(45) Date of Patent: Apr. 19, 2016

(54) COATED ARTICLE AND COATING PROCESS THEREFOR

(75) Inventor: Neil B. Ridgeway, South Windsor, CT (US)

(73) Assignee: United Technologies Corporation, Hartford, CT (US)

( * ) Notice: Subject to any disclaimer, the term of this patent is extended or adjusted under 35 U.S.C. 154(b) by 1217 days.

(21) Appl. No.: 12/717,236

(22) Filed: Mar. 4, 2010

(65) Prior Publication Data

US 2011/0217560 A1 Sep. 8, 2011

(51) Int. Cl.

| | |
|---|---|
| ***G11B 5/84*** | (2006.01) |
| ***C23C 28/00*** | (2006.01) |
| ***C23C 28/02*** | (2006.01) |
| ***C23C 30/00*** | (2006.01) |

(52) U.S. Cl.

CPC ..... *C23C 28/00* (2013.01); *C23C 28/02* (2013.01); *C23C 30/00* (2013.01); *Y10T 428/31678* (2015.04)

(58) Field of Classification Search

None

See application file for complete search history.

(56) References Cited

U.S. PATENT DOCUMENTS

| | | | | |
|---|---|---|---|---|
| 3,612,387 | A * | 10/1971 | Rathbun | 228/6.1 |
| 4,096,296 | A * | 6/1978 | Galmiche et al. | 427/247 |
| 4,676,994 | A | 6/1987 | Demaray | |
| 4,681,818 | A | 7/1987 | Unnam | |
| 5,087,477 | A | 2/1992 | Giggins | |
| 5,538,796 | A | 7/1996 | Schaffer et al. | |
| 5,601,652 | A | 2/1997 | Mullin | |
| 5,763,008 | A * | 6/1998 | Sarin et al. | 427/255.395 |
| 6,296,945 | B1 | 10/2001 | Subramanian | |
| 6,478,888 | B1 | 11/2002 | Burns | |
| 2001/0055653 | A1 | 12/2001 | Dopper | |
| 2002/0152961 | A1 * | 10/2002 | Burns | 118/724 |
| 2003/0041928 | A1 | 3/2003 | Spitsberg et al. | |
| 2003/0113478 | A1 * | 6/2003 | Dang et al. | 427/535 |
| 2008/0292873 | A1 * | 11/2008 | Nijdam et al. | 428/332 |

FOREIGN PATENT DOCUMENTS

| | | |
|---|---|---|
| EP | 0926257 | 12/1998 |
| EP | 0937786 | 2/1999 |
| EP | 926257 | 6/1999 |
| EP | 1734148 | 6/2006 |
| EP | 1746185 | 1/2007 |
| EP | 1908857 | 4/2008 |

(Continued)

OTHER PUBLICATIONS

T.J. Nijdam, W.G. Sloof, "Combined pre-annealing and pre-oxidation treatment for the processing of thermal barrier coatings on NiCoCrA1Y bond coatings", vol. 201, No. 7, Dec. 20, 2006, Elsevier, Amsterdam, Netherlands,.

(Continued)

*Primary Examiner* — Joseph Miller, Jr.

(74) *Attorney, Agent, or Firm* — Carlson, Gaskey & Olds, P.C.

(57) ABSTRACT

A coating process includes preheating a workpiece having an aluminum-containing layer through a temperature range in a reducing atmosphere having hydrogen to limit formation of thermally grown oxides on the surface of the workpiece. A source of oxygen is introduced to establish an oxidizing atmosphere at a temperature above the temperature range to form a desired type of thermally grown oxide on the surfaces of the workpiece. A coating is then deposited on the desired type of thermally grown oxide.

20 Claims, 1 Drawing Sheet

(56) References Cited

FOREIGN PATENT DOCUMENTS

| | | |
|---|---|---|
| EP | 2236642 | 10/2010 |
| JP | 2006328499 | 7/2006 |
| WO | 0236844 | 5/2002 |

OTHER PUBLICATIONS

Extended European Search Report dated Apr. 14, 2011.

* cited by examiner

COATED ARTICLE AND COATING PROCESS THEREFOR

BACKGROUND

This disclosure relates to coatings and, more particularly, to coating systems having improved durability.

Turbine engine components, such as airfoils, and other types of articles typically operate in severe environments. For instance, an airfoil may operate under high temperatures, corrosive conditions, and a variety of different stresses. The article may include a coating for protecting against the environmental conditions. The article may also include a bond coat under the protective coating to promote adhesion between the protective coating and the underlying substrate of the article.

SUMMARY

An exemplary coating process includes preheating a workpiece having an aluminum-containing layer through a temperature range in a reducing atmosphere having hydrogen to limit formation of thermally grown oxides on the surface of the workpiece. A source of oxygen is then introduced to establish an oxidizing atmosphere at a temperature above the temperature range to form a desired type of thermally grown oxide on the surfaces of the workpiece. A coating is then deposited on the desired type of thermally grown oxide.

In another aspect, a coating process includes preheating a metallic workpiece having an aluminum-containing layer through a temperature range from 700° F. (371° C.) to at least 1800° F. (982° C.) in a reducing atmosphere having hydrogen to limit formation of undesired types of thermally grown oxides on the surfaces of the metallic workpiece. A source of oxygen is then introduced to establish an oxidizing atmosphere at a temperature above the temperature range to form a continuous alpha alumina thermally grown oxide on the surfaces of the workpiece. A ceramic coating is then deposited on the continuous alpha alumina thermally grown oxide.

An exemplary coated article includes a body, a continuous thermally grown oxide on the body, and a coating on the continuous thermally grown oxide.

BRIEF DESCRIPTION OF THE DRAWINGS

The various features and advantages of the disclosed examples will become apparent to those skilled in the art from the following detailed description. The drawings that accompany the detailed description can be briefly described as follows.

DETAILED DESCRIPTION OF THE PREFERRED EMBODIMENT

Figure 1:
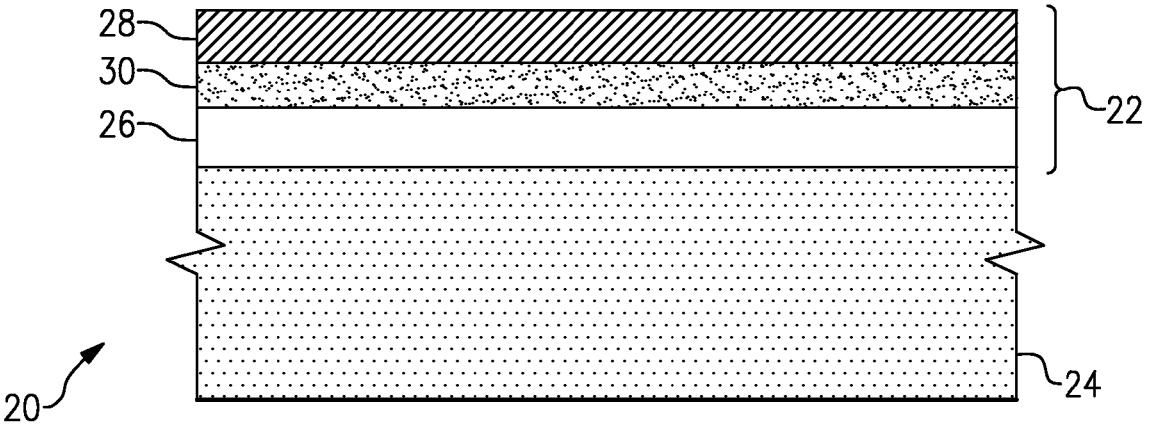
FIG. 1 illustrates an example coated article.

FIG. 1 illustrates an example article 20 having a multi-layer coating system 22 disposed thereon for protecting the article 20 in an end use environment. In this regard, the article 20 may be any type of article that would benefit from the examples disclosed herein and may be, for example only, a gas turbine engine component or aerospace component that operates under relatively severe conditions.

In the illustrated example, the article 20 includes a body 24 that serves as a substrate for the multi-layer coating system 22. In the example of a turbine engine component, the body 24 may be a cast or formed superalloy substrate having the substantial design shape of the component, for example. Generally, the body 24 may be a metallic body formed from a metallic alloy, such as a nickel-based alloy or cobalt-based alloy. Other superalloys or metallic alloys may alternatively be used.

The multi-layer coating system 22 may include an aluminum-containing layer 26, such as a bond coat, and a coating 28 (e.g., a topcoat, multi-layered coating, etc.) disposed on the aluminum-containing layer 26. A desired type of thermally grown oxide layer 30 is disposed between the aluminum-containing layer 26 and the outer coating 28. As an example, the thermally grown oxide layer 30 promotes adhesion between the aluminum-containing layer 26 and the coating 28 to ultimately enhance the durability of the article 20.

The coating 28 may be a ceramic coating that serves as a thermal barrier for the underlying body 24. In some examples, the ceramic coating includes zirconia, hafnia, or combinations thereof. For instance, the ceramic coating may include gadolinia-zirconia, gadolinia-hafnia, yttria-zirconia or compounds or other solid solutions based on zirconium or hafnium, such as those including lanthanide elements, scandium, indium, yttrium, molybdenum, carbon, magnesium, or rare earth oxides. In other examples, the ceramic coating may be gadolinium zirconate or hafnium zirconate.

The aluminum-containing layer 26 may be a bond coat that including a composition of metal-chromium-aluminum-yttrium ("MCrAlY"), aluminide, platinum aluminide, or a lower-aluminum gamma/gamma prime type coating. In other examples, the aluminum-containing layer 26 may be an alloy composition, such as PWA 1487, that includes aluminum that develops the thermally grown oxide 30.

The thermally grown oxide 30 on the aluminum-containing layer 26 is a desired type of oxide that facilitates strong bonding between the coating 28 and the body 24. In the case of the coating 28 being a ceramic coating, certain types of thermally grown oxides may be more desirable for promoting good bonding between the coating 28 and the body 24. For instance, alpha alumina provides good adhesion to ceramic coatings and is therefore desired to enhance the durability of the article 20. However, contrary to this desire, other types of oxides can readily form during the processing of the article 20.

Figure 2:
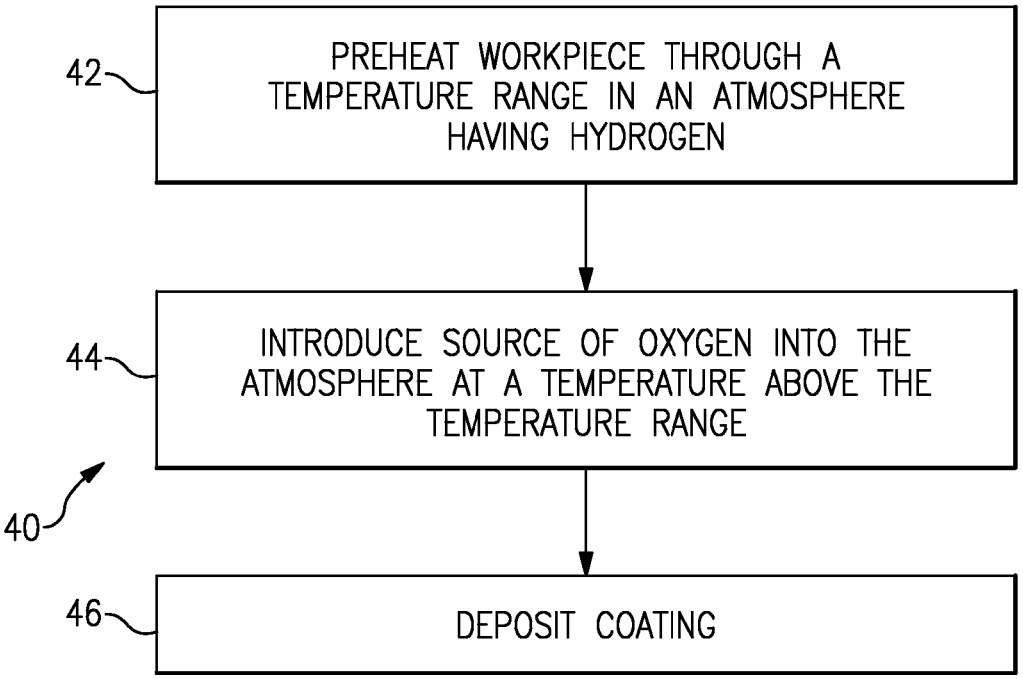
FIG. 2 illustrates an example coating process.

FIG. 2 illustrates an example coating process 40 that may be used to fabricate the example coated article 20 with the desired type of thermally grown oxide 30. The coating process 40 includes a preheating step 42, an oxygen introduction step 44, and a deposition step 46.

In some examples, the coating process 40 may be used with electron beam physical vapor deposition ("EB-PVD") equipment or electron beam directed vapor deposition ("EB-DVD") equipment to provide a multi-layer coating having enhanced spallation resistance. Ceramic coatings applied by electron beam vapor deposition may be sensitive to the type of thermally grown oxide. To this end, the disclosed coating process 40 provides the ability to produce a continuous, homogenous, alpha alumina thermally grown oxide that is desirable for enhancing durability of electron beam vapor-deposited ceramic coatings.

In the illustrated example, the preheating step 42 generally includes preheating a workpiece (e.g., substrate 24 with aluminum-containing layer 26) through a temperature range in a reducing atmosphere having hydrogen. The preheating step 42 is conducted prior to depositing the coating 28. As will be described in more detail, the hydrogen limits or avoids formation of thermally grown oxides, such as metastable alumina, on the surfaces of the workpiece while the workpiece is being heated through the temperature range. That is, the preheating step 42 utilizes a protective or reducing atmosphere as an avoidance measure to stop or inhibit growth of thermally grown oxide. The oxygen introduction step 44 includes introducing a source of oxygen to establish an oxidizing atmosphere at a treatment temperature above the temperature range to form the desired type of thermally grown oxide in a controlled manner on the surfaces of the workpiece. The deposition step 46 includes depositing a coating on the desired type of thermally grown oxide.

The temperature range and treatment temperature of interest in the coating process 40 may depend upon the type of thermally grown oxide that is desired and the types of thermally grown oxides that are to be avoided. For instance, the temperature range in the preheating step 42 may be from about 700° F. (371° C.) to at least 1800° F. (982° C.). Within this temperature range, the aluminum from the aluminum-containing layer 26 forms aluminum oxide phases that are relatively weak or provide poor adhesion with the coating 28. Thus, preheating the workpiece in the atmosphere having hydrogen limits formation of these undesired phases by consuming any oxygen in the atmosphere to prevent the oxygen from reacting with the aluminum. Also, the hydrogen may chemically reduce any undesired oxide phases that do form. The temperature range may differ from the above example, which is tailored to providing alpha alumina to the exclusion of other oxides, depending on the type of oxides that are desired and undesired. Given this description, one of ordinary skill in the art will be able to determine appropriate temperature ranges to meet their particular needs.

Once the temperature of the atmosphere and workpiece is above the temperature range where undesired oxides form, the source of oxygen can be introduced in order to form the desired type of thermally grown oxide. For instance, alpha alumina forms above the temperature of about 1800° F. (982° C.). Alpha alumina provides good adhesion and strength and forms at temperatures of approximately 1850° F.-1950° F. (1010° C.-1065° C.). Therefore, once the atmosphere and workpiece are within the temperature range of 1850° F.-1950° F., the source of oxygen may be introduced such that alpha alumina forms. Further, alpha alumina formation excludes later formation of other types of aluminum oxide phases. Thus, avoiding formation of other oxide phases during preheating to preferentially form alpha alumina, facilitates forming a continuous, homogenous alpha alumina thermally grown oxide even though further processing of the work piece may include heating or cooling through the temperature range 700° F. to 1800° F.

After formation of the desired type of thermally grown oxide, the coating 28 is deposited onto the thermally grown oxide in a known manner. Although not limited to any particular type of coating, the coating process 40 may be adapted for use in equipment for electron beam vapor deposition.

In some examples, the preheating step 42 may be conducted in a load-lock chamber and/or preheating chamber of the electron beam vapor deposition equipment, the oxygen introduction step 44 may be conducted in the preheating chamber, and the deposition step 46 may be conducted in a deposition chamber of the electron beam vapor deposition equipment. In this regard, the equipment may be adapted in a known manner with one or more ports for controlling the atmosphere within the chambers with regard to hydrogen, oxygen, and overall pressure (e.g., using valves, one or more vacuum pumps, etc.).

As an example, to establish an atmosphere having hydrogen in the load-lock chamber and/or preheating chamber, the chamber(s) may be back-filled with hydrogen from a hydrogen gas source. In some examples, the chamber(s) may be repeatedly back-filled with hydrogen, pumped down, and back-filled with hydrogen again to purge other gases from the chamber such that hydrogen is the most abundant element on a molar basis.

The preheating may be conducted with the atmosphere in the chamber(s) at approximately ambient pressures (1 atmosphere) or at sub-ambient pressures. Heating at ambient pressures or at pressures close to ambient rather than at the coating processing pressures ($>10^{-4}$ torr), facilitates rapid radiant heating through the temperature range where undesired oxides form. Thus, the use of hydrogen in the atmosphere during preheating provides the added benefit of rapidly heating the workpiece to avoid forming the undesired oxides. However, in other examples, the preheating may alternatively be conducted at the coating processing pressures.

If a relatively elevated pressure is used during preheating, this first pressure may be reduced to a second pressure for introducing the source of oxygen once the temperature elevates above the temperature range where the undesired oxides form. The second pressure may be the coating processing pressure (e.g., $>10^{-4}$ torr) or a pressure near the coating processing pressure.

In a further example, the oxygen introduction step 44 may include introducing moist hydrogen as the source of oxygen. The introduction of moist hydrogen may be conducted by flowing dry hydrogen gas through liquid water to provide the moist hydrogen. Thus, while the workpiece is being preheated through the lower temperature range where undesirable oxides may form, the hydrogen consumes oxygen within the atmosphere and may chemically reduce any oxides that form on the surface of the workpiece. However, when the moist hydrogen is provided at the higher treatment temperature where alpha aluminum forms, there is enough oxygen within the atmosphere to substantially overcome the influence of the hydrogen and thereby oxidize the aluminum-containing layer 26 in a controlled manner. Carbon dioxide ($CO_2$) may be used as an alternative to moist hydrogen as the oxygen source. As an example, the hydrogen may be mixed with carbon dioxide gas in a desired ratio for introduction into the atmosphere.

Although a combination of features is shown in the illustrated examples, not all of them need to be combined to realize the benefits of various embodiments of this disclosure. In other words, a system designed according to an embodiment of this disclosure will not necessarily include all of the features shown in any one of the Figures or all of the portions schematically shown in the Figures. Moreover, selected features of one example embodiment may be combined with selected features of other example embodiments.

The preceding description is exemplary rather than limiting in nature. Variations and modifications to the disclosed examples may become apparent to those skilled in the art that do not necessarily depart from the essence of this disclosure. The scope of legal protection given to this disclosure can only be determined by studying the following claims.

What is claimed is:

1. A coating process comprising:

preheating a workpiece having an aluminum-containing layer through a temperature range in a reducing atmosphere having hydrogen to thereby limit formation of thermally grown oxides on the surfaces of the workpiece;

introducing a source of oxygen to establish an oxidizing atmosphere at a temperature above the temperature range to form a desired type of thermally grown oxide on the surfaces of the workpiece; and depositing a coating on the desired type of thermally grown oxide wherein the preheating is conducted at approximately ambient pressure.

2. A coating process as recited in claim 1, wherein the most abundant element in the reducing atmosphere is the hydrogen.

3. The coating process as recited in claim 1, wherein the introducing of the source of oxygen includes introducing moist hydrogen as the source of oxygen.

4. The coating process as recited in claim 3, wherein the introducing of the moist hydrogen includes flowing hydrogen gas through liquid water to provide the moist hydrogen.

5. The coating process as recited in claim 1, wherein the temperature range is 700° F.-1800° F. (371° C.-982° C.) and the temperature at which the source of oxygen is introduced is 1850° F.-1950° F. (1010° C.-1065° C.).

6. The coating process as recited in claim 1, wherein the depositing of the coating includes depositing a coating selected from a group consisting of zirconia, hafnia, and combinations thereof.

7. The coating process as recited in claim 1, wherein the workpiece is a metallic workpiece and the desired type of thermally grown oxide is alpha alumina.

8. The coating process as recited in claim 1, wherein the preheating includes preheating in the reducing atmosphere at a first pressure and then, above the temperature range, reducing the first pressure to a second pressure for introducing the source of oxygen.

9. The coating process as recited in claim 1, wherein the hydrogen in the preheating consumes oxygen present in the reducing atmosphere to prevent the oxygen from reacting with the aluminum-containing layer.

10. The coating process as recited in claim 1, wherein the preheating includes repeatedly back-filling with the hydrogen, pumping down, and back-filling with the hydrogen again to purge other gases such that the hydrogen is the most abundant element in the reducing atmosphere on a molar basis.

11. The coating process as recited in claim 1, wherein, in the preheating, there is there is not enough oxygen to overcome the hydrogen and oxidize the aluminum-containing layer to form the thermally grown oxides on the surfaces of the workpiece and, after the introduction of the source of oxygen, there is enough oxygen to overcome the hydrogen and oxidize the aluminum-containing layer to form the desired type of thermally grown oxide on the surfaces of the workpiece.

12. The coating process as recited in claim 1, wherein the reducing atmosphere stops formation of thermally grown oxides on the surfaces of the workpiece.

13. A coating process comprising:

preheating a workpiece having an aluminum-containing layer through a temperature range in a reducing atmosphere having hydrogen to thereby limit formation of thermally grown oxides on the surfaces of the workpiece;

introducing a source of oxygen to establish an oxidizing atmosphere at a temperature above the temperature range to form a desired type of thermally grown oxide on the surfaces of the workpiece; and depositing a coating on the desired type of thermally grown oxide wherein the source of oxygen is carbon dioxide.

14. The coating process as recited in claim 13, wherein the preheating is conducted at a sub-ambient pressure.

15. A coating process comprising:

preheating a workpiece having an aluminum-containing layer through a temperature range in a reducing atmosphere having hydrogen to thereby limit formation of thermally grown oxides on the surfaces of the workpiece;

introducing a source of oxygen to establish an oxidizing atmosphere at a temperature above the temperature range to form a desired type of thermally grown oxide on the surfaces of the workpiece; and depositing a coating on the desired type of thermally grown oxide wherein the source of oxygen is a mixture of carbon dioxide and hydrogen.

16. The coating process as recited in claim 15, wherein the preheating is conducted at a sub-ambient pressure.

17. A coating process comprising:

preheating a workpiece having an aluminum-containing layer through a temperature range in a reducing atmosphere having hydrogen to thereby limit formation of thermally grown oxides on the surfaces of the workpiece;

introducing a source of oxygen to establish an oxidizing atmosphere at a temperature above the temperature range to form a desired type of thermally grown oxide on the surfaces of the workpiece; and depositing a coating on the desired type of thermally grown oxide, wherein the hydrogen in the preheating consumes oxygen present in the reducing atmosphere to prevent the oxygen from reacting with the aluminum-containing layer.

18. The coating process as recited in claim 17, wherein:

the temperature range is 700° F.-1800° F. (371° C.-982° C.) and the temperature at which the source of oxygen is introduced is 1850° F.-1950° F. (1010° C.-1065° C.), the depositing of the coating includes depositing a coating selected from the group consisting of zirconia, hafnia, and combinations thereof, and the workpiece is a metallic workpiece and the desired type of thermally grown oxide is alpha alumina.

19. The coating process as recited in claim 17, wherein the preheating includes preheating in the reducing atmosphere at a first pressure and then, above the temperature range, reducing the first pressure to a second pressure for introducing the source of oxygen.

20. The coating process as recited in claim 17, wherein, in the preheating, there is there is not enough oxygen to overcome the hydrogen and oxidize the aluminum-containing layer to form the thermally grown oxides on the surfaces of the workpiece and, after the introduction of the source of oxygen, there is enough oxygen to overcome the hydrogen and oxidize the aluminum-containing layer to form the desired type of thermally grown oxide on the surfaces of the workpiece.

* * * * *